US005864208A

United States Patent [19]

McDonald

[11] Patent Number: 5,864,208

[45] Date of Patent: Jan. 26, 1999

[54] SPARK GAP DEVICE AND METHOD OF MANUFACTURING SAME

[75] Inventor: Richard J. McDonald, Salem, Mass.

[73] Assignee: EG&G Corporation, Wellesley, Mass.

[21] Appl. No.: 696,204

[22] Filed: Aug. 13, 1996

[51] Int. Cl.[6] ..... H01J 9/18

[52] U.S. Cl. ..... 313/592; 445/29; 361/120

[58] Field of Search ..... 313/589, 592, 313/595, 602, 603; 361/120; 445/22, 29

[56] References Cited

U.S. PATENT DOCUMENTS

| | | | |
|---|---|---|---|
| 3,818,277 | 6/1974 | Gersing . | |
| 3,886,818 | 6/1975 | Wurst . | |
| 3,889,160 | 6/1975 | Cobarg . | |
| 3,891,917 | 6/1975 | Harris . | |
| 3,892,219 | 7/1975 | Preiser et al. . | |
| 3,894,273 | 7/1975 | Newport, Jr. et al. . | |
| 3,905,955 | 9/1975 | Katz . | |
| 3,945,362 | 3/1976 | Neuman et al. . | |
| 3,950,124 | 4/1976 | Berry . | |
| 3,973,544 | 8/1976 | Suda . | |
| 4,051,828 | 10/1977 | Topic . | |
| 4,054,813 | 10/1977 | Agnoux et al. | 313/595 X |
| 4,109,167 | 8/1978 | Kaji et al. . | |
| 4,144,859 | 3/1979 | Ohki et al. . | |
| 4,149,214 | 4/1979 | Harrison et al. . | |
| 4,186,337 | 1/1980 | Volk et al. . | |
| 4,214,211 | 7/1980 | Yokogawa . | |
| 4,245,610 | 1/1981 | Sugiura . | |
| 4,322,777 | 3/1982 | Ueta et al. . | |
| 4,366,523 | 12/1982 | Hasse et al. | 361/120 |
| 4,392,474 | 7/1983 | Minner . | |
| 4,395,981 | 8/1983 | Podrapsky et al. . | |
| 4,401,096 | 8/1983 | Podrapsky . | |
| 4,574,221 | 3/1986 | Hess et al. . | |
| 4,620,113 | 10/1986 | Sizer, II et al. . | |
| 4,680,005 | 7/1987 | Geary . | |
| 4,709,684 | 12/1987 | Kaiser et al. . | |
| 4,710,681 | 12/1987 | Zivkovich . | |
| 4,713,516 | 12/1987 | Buhler et al. . | |
| 4,767,912 | 8/1988 | Eldridge . | |
| 4,839,772 | 6/1989 | Choi et al. . | |
| 4,872,084 | 10/1989 | Dunning et al. . | |
| 5,056,481 | 10/1991 | Podrapsky et al. . | |
| 5,287,048 | 2/1994 | Lakin et al. . | |
| 5,399,825 | 3/1995 | Valenzuela . | |
| 5,419,358 | 5/1995 | Sun . | |
| 5,452,069 | 9/1995 | Arnold et al. . | |
| 5,475,618 | 12/1995 | Le . | |

FOREIGN PATENT DOCUMENTS

| | | |
|---|---|---|
| 0 151 764 | 12/1984 | European Pat. Off. . |
| 0 175 145 B1 | 8/1985 | European Pat. Off. . |
| 0 257 795 B1 | 7/1987 | European Pat. Off. . |
| 0 396 291 B1 | 4/1990 | European Pat. Off. . |
| 0 548 932 B1 | 12/1992 | European Pat. Off. . |

*Primary Examiner*—Kenneth J. Ramsey
*Attorney, Agent, or Firm*—Iandiorio & Teska

[57] ABSTRACT

A method of manufacturing a spark gap device. The method includes using standard metal transistor base and cap components, machining the base to cut out a portion of the top of the base, filling the base with an insulative substrate and placing a pin through the insulative substrate, depositing a first electrode on the top portion of the base in electrical contact with the metal portion of the base, and sealing the cap with respect to the base. Also featured is a spark gap device which eliminates heat related and electrode sputtering failures associated with prior art glass or ceramic spark gap devices.

32 Claims, 4 Drawing Sheets

SPARK GAP DEVICE AND METHOD OF MANUFACTURING SAME

FIELD OF INVENTION

This invention relates to an improved, high reliability, low cost spark gap device manufactured using slightly modified standard metal transistor package components.

BACKGROUND OF INVENTION

Spark gap devices are used in detonator firing mechanisms, high intensity discharge lighting systems, and numerous other environments.

Prior art spark gap devices are highly unreliable and have extremely short lives. Most spark gap devices include a pair of spaced cone-shaped electrodes in a glass or ceramic gas filled housing. At an average breakdown voltage of approximately 1.5 kilovolts, these prior art devices usually fail after about 15,000 firings for one of two reasons. In the first failure mode, the electrode material sputters and becomes affixed to the inside of the glass or ceramic surface of the housing thereby causing a short. In the second failure mode, the heat generated as the device is fired over time shatters the glass or ceramic housing. In addition, these types of prior art devices are likely sources of EMI and RFI. Moreover, it is difficult to obtain a reliable seal between the metal bases and the ceramic or glass housing.

Higher reliability, longer life spark gap devices are expensive to manufacture and cannot be used efficiently in many kinds of products due to their high cost.

SUMMARY OF INVENTION: I

It is therefore an object of this invention to provide an improved spark gap device.

It is a further object of this invention to provide a method of manufacturing a cost effective and yet reliable spark gap device.

It is a further object of this invention to provide such a method which utilizes and which incorporates low-cost components.

It is a further object of this invention to provide such a spark gap which has an increased useful life, on the order of millions of firings.

It is a further object of this invention to provide such a spark gap device which does not suffer from heat-related failures.

It is a further object of this invention to provide such a spark gap device which is not a source of EMI or RFI.

It is a further object of this invention to provide such a spark gap device which is manufactured using slightly modified standard metal transistor packages.

It is a further object of this invention to provide such a spark gap device and method of manufacturing which eliminates the need for expensive and complex ceramic to metal seals.

It is a further object of this invention to provide such a spark gap device and manufacturing method which improves heat dissipation and heat sinking.

This invention results from the realization that a high reliability, low cost spark gap device can be manufactured by using slightly modified standard metal transistor package components which house electrodes with flat surfaces so that any sputtering of the electrode material is captured by the electrodes and is not deposited on the inside surfaces of the housing.

The inexpensive metal transistor package survives many millions of firings of the electrodes without thermal failure which occurs with standard glass or ceramic housings. The metal transistor package also provides EMI and RFI confinement. The unique orientation and configuration of electrodes reduces the failures associated with the prior art devices and a device manufactured in accordance with the method of this invention survives many millions of firings. In addition, the unreliable high cost glass or ceramic to metal seal associated with prior art devices is eliminated.

This invention features a method of manufacturing a spark gap device. The method comprises procuring a metal transistor base and cap; machining the base to cut out a portion of the top of the base; filling the base with an insulative substrate and placing a pin through the insulative substrate; depositing a first electrode on the top portion of the base in electrical contact with the metal portion of the base; and sealing the cap with respect to the base. The metal transistor base and cap offer a low cost and yet highly reliable alternative to prior art ceramic or glass spark gap devices. Heat related failures are reduced and expensive glass or ceramic to metal seals are not required.

The method preferably includes the step of fixing a second electrode to the pin. The second electrode may include an arm terminating in a flat portion spaced above the first electrode. In other embodiments, the second electrode is the pin itself. In still other embodiments, the second electrode is placed near or on the interior top surface of the cap. In one embodiment, a trigger pin is placed in the insulative substrate. In still another embodiment, a second pin is inserted through the top surface of the cap and electrically isolated with respect to the top surface of the cap. A second electrode may be welded to the second pin.

The cap is preferably made of Kovar, the first electrode is predominantly made of tungsten, and may include traces of barium and nickel. The second electrode is predominantly molybdenum. Both electrodes, however, may be made of tungsten or molybdenum depending on the desired characteristics of the device. The cap may be filled with a gas such as nitrogen, again depending on the performance requirements of the specific device.

This invention also features the product made by the process shown and described. This invention also includes a spark gap device comprising: a base including a top face with a conductive portion and an insulative portion; a first pin extending through the insulative portion of the base; a first electrode spaced from the pin; and a conductive cap sealingly engaged to the conductive portion of the base.

In contrast, prior art devices are made of glass or ceramic and suffer from electrode sputtering and heat related failures. Also, the prior art devices lack a base with a conductive portion and an insulative portion.

The first electrode is preferably located at least partially on the conductive portion of the top face of the base. The pin preferably includes a conductive arm terminating in a flat second electrode spaced above the first electrode. The flat second electrode is preferably made of molybdenum. Unlike the prior art devices, the flat electrodes shield any material sputtered off the opposing electrode from deposition on the interior surfaces of the housing thus eliminating failures. The spark gap device may include a trigger pin in devices which are subject to a trigger voltage. The first electrode is predominantly tungsten and the cap is made of Kovar.

In one embodiment, there is a base including a top face with a conductive portion and an insulative portion; a pin extending above the top face and through the insulative portion; a first electrode residing at least partially on the conductive portion of the top face of the base and electrically isolated from the pin; an arm with one end fixed to the pin and an opposite end including a flat second electrode spaced above the first electrode; and a conductive cap sealingly engaged with respect to the base. There may also be a trigger pin extending through the base electrically isolated from the first electrode.

This invention also features a spark gap device comprising: a base including a top face with a conductive portion and an insulative portion; a first electrode in electrical contact with the conductive portion of the base; and a second electrode electrically isolated from and spaced with respect to the first electrode. A conductive cap is sealingly engaged with respect to the base. This spark gap device may further include a pin extending through the insulative portion of the base and in electrical contact with the second electrode and/or a trigger pin electrically connected to the first electrode.

In another embodiment, there is a base including a conductive portion and an insulative portion; a pin extending through the insulative portion of the base and terminating in a first flat electrode; a conductive cap sealingly engaged with respect to the base; and a second flat electrode spaced from the first flat electrode along the longitudinal axis of the device. The second flat electrode may be fixed to the interior top surface of the cap. Alternatively, the top surface of the cap includes an insulative portion, and the device further includes a trigger pin extending through the insulative portion of the cap. In this embodiment, the second flat electrode is fixed to the trigger pin.

The invention also features a sputter-resistant spark gap device. There is a housing including: a base with a conductive portion and an insulative portion, a conductive cap sealingly engaged with respect to the conductive portion of the base; and first and second spaced electrodes within the housing, at least the first electrode electrically isolated with respect to the housing. Each electrode includes a planar surface facing the opposing electrode to capture sputtering of electrode material from the opposing electrode.

In one embodiment, the first electrode is fixed to a pin extending through the insulative portion of the base. Another embodiment includes a trigger pin. The second electrode is fixed to the trigger pin. The second electrode may reside on the conductive portion of the base or on the interior top surface of the cap.

DISCLOSURE OF PREFERRED EMBODIMENT

Other objects, features and advantages will occur to those skilled in the art from the following description of a preferred embodiment and the accompanying drawings, in which.

Figure 1:
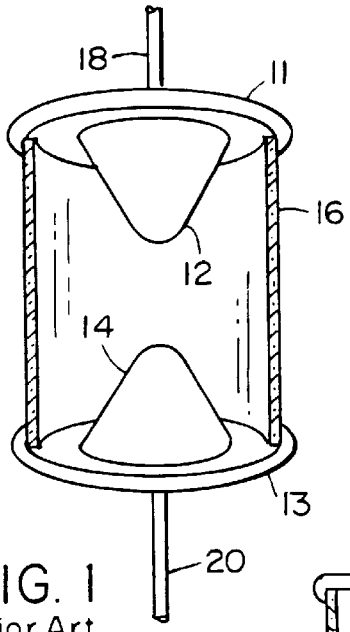
FIG. 1 Prior Art
FIG. 1 is a schematic view of a prior art glass or ceramic spark gap device.

Prior art spark gap device 10, FIG. 1, includes electrodes 12 and 14 within glass or ceramic gas-filled housing or case 16. Leads 18 and 20 are in electrical contact with electrodes 12 and 14, residing on metal base plates 11 and 13, respectively. When a predetermined voltage (for example, a voltage of 1.5 kilovolts), is applied to lead 20, a spark will jump the gap between electrodes 12 and 14; any lesser voltage will preclude the possibility of a voltage output on lead 18. Such devices are used in a variety of applications including detonator mechanisms and high-intensity lighting systems.

Figure 2:
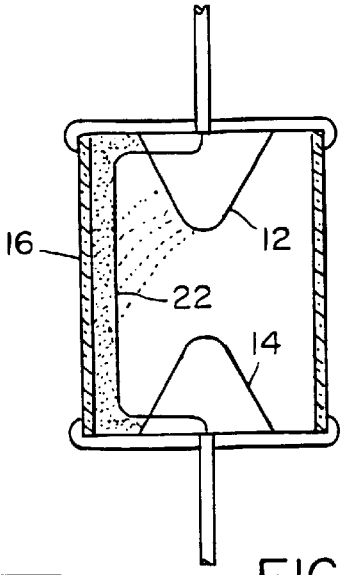
FIG. 2 Prior Art
FIG. 2 is a cutaway view showing the deposition of electrode material on the inside surface of the glass or ceramic housing in one failure mode of the prior art devices of this type.

As discussed in the Background of Invention above, the first failure mode associated with prior art device 10 is the sputtering of electrode material from electrode 12 and 14 onto the inside surface of glass or ceramic housing 16 as shown in FIG. 2. After only a few thousand firings of device 10, an electrical short will typically exist along the path shown by line 22.

Figure 3:
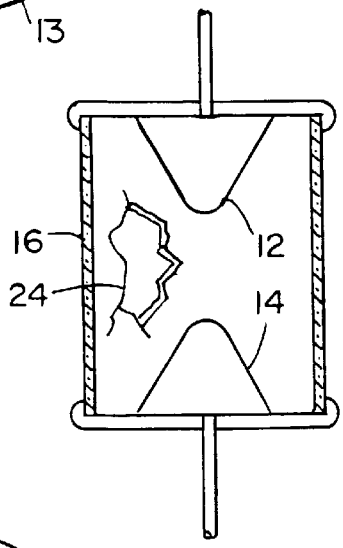
FIG. 3 Prior Art
FIG. 3 is a schematic view of the prior art device shown in FIG. 1 depicting the second heat related failure mode associated with prior art devices of this type.

In the second failure mode, the heat generated by repeated firings of device 10 will shatter or crack housing 16 as shown at 24 in FIG. 3. In addition, such a device is a source of EMI or RFI. Finally, it is expensive and often difficult to create a reliable seal between glass or ceramic housing 16, FIG. 1, and metal base plates 11 and 13.

Spark gap device 40, FIG. 4, of this invention, however, is manufactured using a standard transistor outline (TO) package 42, slightly modified as discussed with reference to FIGS. 5–13. Transistor package 42 is metal, thus providing improved heat dissipation and heat sinking as well as EMI and RFI confinement. A standard TO-5 package has a standard 0.018 inch diameter lead. In this invention the diameter of lead 44 is increased to 0.040 inch in order to physically support the internal electrodes and to support the increased current carrying capacity of the device. Another modification made to the standard package is to increase the glass to metal ratio of base portion 48 (also called the "header") to provide additional voltage hold off capability. In the prior art devices shown in FIGS. 1–3, the distance from the electrodes to the glass housing is only 0.020 inch thus rendering the device susceptible to sputtering failures as discussed above.

Figure 5:
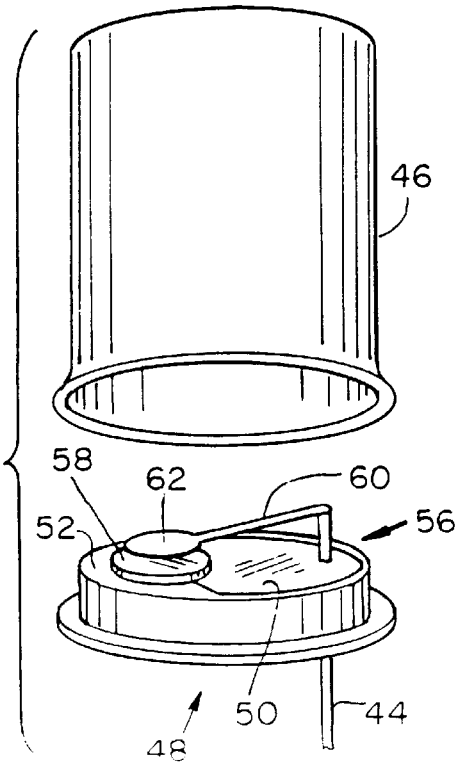
FIG. 5 is an exploded view of the spark gap device shown in FIG. 4.
Figure 9:
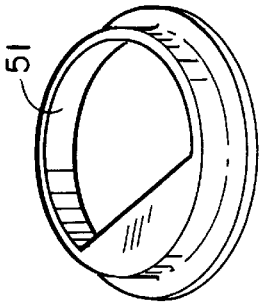
FIG. 9 is a schematic view of the step of stamping out the base portion of a standard TO-5 base in accordance with the method of this invention.

In this invention, the distance from the electrodes 58 and 62 to housing 46, FIG. 5, is a minimum of 0.050 inch. This is accomplished in part by offsetting pin 44, FIG. 5, with respect to the center of base 48.

Figure 4:
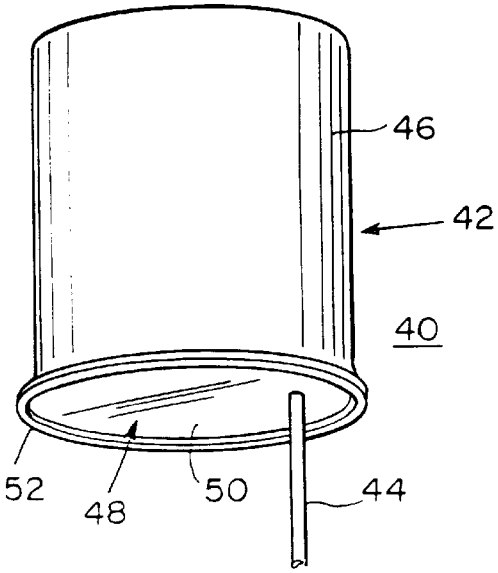
FIG. 4 is a schematic view of the spark gap device of this invention.

Standard TO-5 package 42, FIG. 4, includes cap 46 and base 48. Base 48 includes insulative portion 50 and conductive portion 52. Cap 46 is sealed with respect to conductive portion 52 of base 48 by welding. The interior of device 40 is filled with a gas such as nitrogen or some other gas depending on the performance requirements. Insulative portion 50 is typically glass, such as glass 7052 or equivalent. Body 42 is preferably Kovar ASTM F15 and lead pin 44 is also Kovar ASTM F15.

In a preferred embodiment, a standard TO-5 base is machined to cut out, preferably by stamping, D-shaped area 50 at the top surface of base which is then filled with an insulative material such as the glass material discussed above. The top face 56 of base 48 thus includes conductive portion 52 and insulative portion 50. Pin 44 extends through insulative portion 50 and a first flat electrode, in this case cathode 58, is deposited partially on conductive portion 52 and partially on insulative portion 50. Cathode 58 is preferably made of 80% tungsten containing a small percentage of barium and nickel. Attached to pin 44 is a conductive molybdenum arm 60 terminating in second flat electrode 62, in this case an anode also made of molybdenum.

Figure 6:
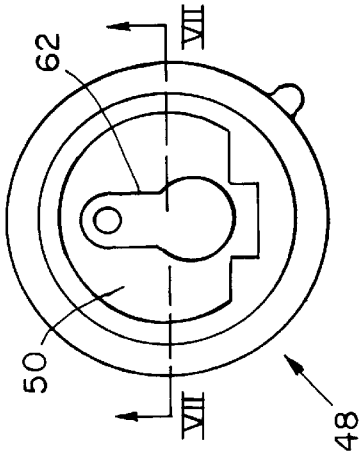
FIG. 6 is a top plan view of the base portion of another embodiment of the spark gap device shown in FIG. 5.
Figure 7:
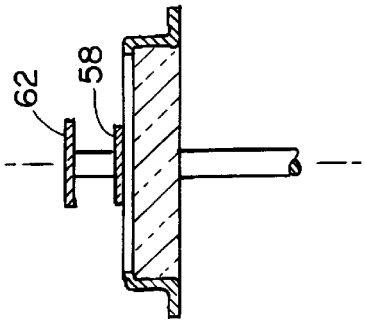
FIG. 7 is a front cut-away view of the base portion of the spark gap device shown in FIG. 6.

In another embodiment, anode 62, FIG. 6, has a slightly broader arm section as shown. The outside radius of base portion 48, FIG. 6, is approximately 0.360 plus or minus 0.002 and the nominal diameter of insulative portion 50 is approximately 0.255 inch. The diameter of flat electrode 58, FIG. 7, is approximately 0.140 plus or minus 0.007 inch. The space between electrode 58 and electrode 62, FIG. 7, is approximately 0.055 plus or minus 0.001 inch. These dimensions will vary depending on the breakdown voltage desired.

As can clearly be seen in FIG. 7, any sputtering of material from flat electrode 58 will be shielded by flat electrode 62; and any sputtering from flat electrode 62 will be captured by flat electrode 58.

Figure 8:
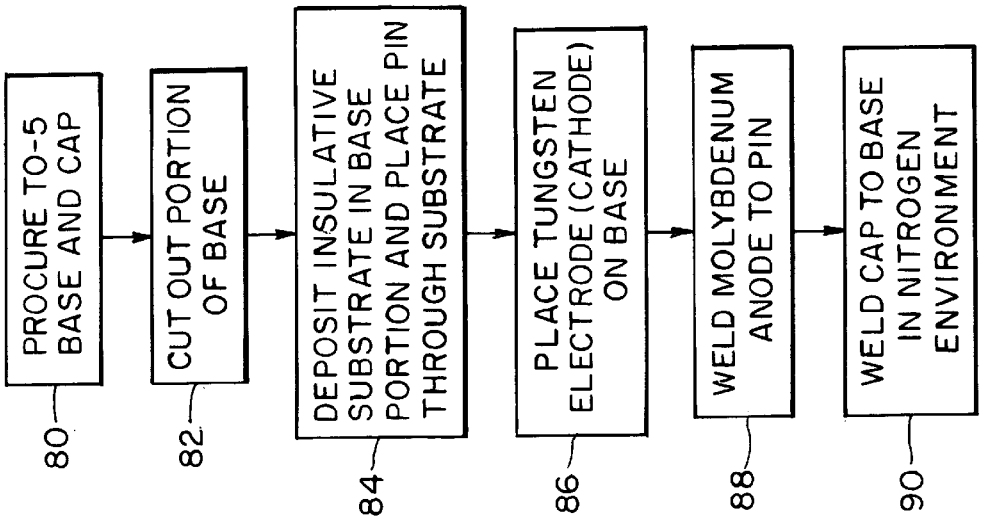
FIG. 8 is a flow chart depicting one method of manufacturing a spark gap device in accordance with this invention.

Such a device is manufactured in accordance with the flow chart shown in FIG. 8. A number of TO-5 base and cap components are procured, step 80, in quantities of 1,000, 10,000 or 50,000 units to reduce the cost of the final assembly. D-shaped portion 51, FIG. 9, of the base is then stamped out, step 82 and the insulative substrate is deposited in the base portion while pin 44, FIGS. 4 and 5, is held in place, step 84. Tungsten electrode 58, FIG. 5, is then placed on the base partially on conductive portion 52 and partially on insulative portion 50, step 86, FIG. 8A. The molybdenum anode 62, FIG. 5, is then welded to pin 44, step 88, FIG. 8A, and Kovar cap 46, FIG. 5, is then welded to base 48, step 90, FIG. 8A in the presence of a gaseous environment.

Figure 10:
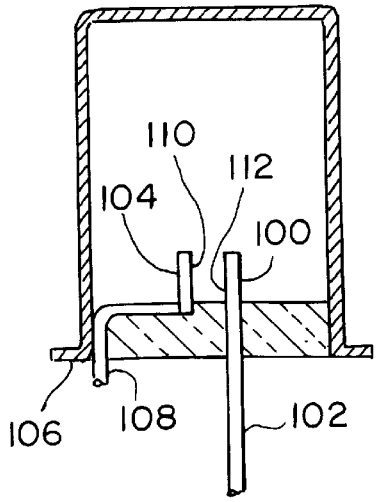
FIG. 10 is a cut-away view of another embodiment of the spark gap device of this invention.

In another embodiment, anode 100, FIG. 10, is the terminal end of pin 102 and cathode 104 is a flat metal plate in electrical contact with metal portion 106 via conductive lead 108. Note that any sputtering which occurs between anode 100 and cathode 104 will be confined to the interior flat faces of each electrode, faces 110 and 112, respectively. In this embodiment, anode 100 and cathode 104 may both be made of tungsten.

Figure 11:
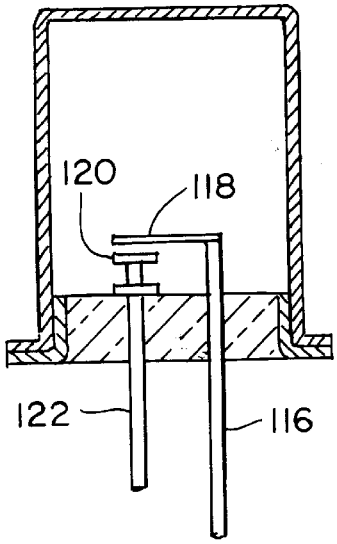
FIG. 11 is a cut-away view of another embodiment of the spark gap device of this invention.

In another embodiment, the device shown in FIGS. 4–7 are modified such that there is a trigger pin 122, FIG. 11, connected to flat molybdenum cathode 121 spaced from and electrically isolated with respect to tungsten cathode 120. A voltage of approximately 2.8 kilovolts is applied between molybdenum anode 118 and cathode 120 but the device will not fire until a voltage of approximately half that much, 1.4 kilovolts, is applied to trigger pin 122. Cathode 120 is connected to base 123 via land 125.

Figure 12:
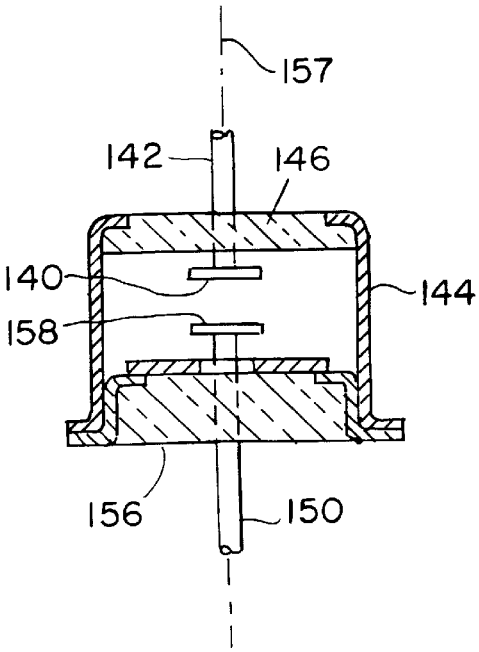
FIG. 12 is a cut-away view of another embodiment of the spark gap device of this invention.

In another embodiment, a coaxial spark gap device is constructed to include anode 140, FIG. 12, connected to anode pin 142 which is insulated with respect to Kovar cap 144 by means of glass-filled top portion 146. Trigger pin 150 is inserted through the insulative portion of the base and terminates in cathode 159 such that flat anode 140 is spaced from flat cathode along the longitudinal axis 157 of the device. Cathode 158 operates in a similar fashion to cathode 120, FIG. 11.

Figure 13:
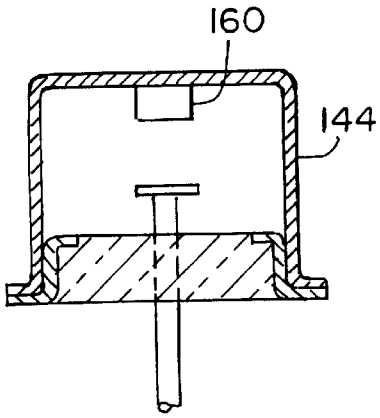
FIG. 13 is a cut-away view of still another embodiment of the spark gap device of this invention.

In a simpler device, cathode 160, FIG. 13, is welded to the unmodified interior surface of Kovar cap 144. Note that the individual features of each of the embodiments shown in FIGS. 4–13 may be combined in ways not shown in the individual drawings depending on the specific application of the spark gap device.

Figure 14:
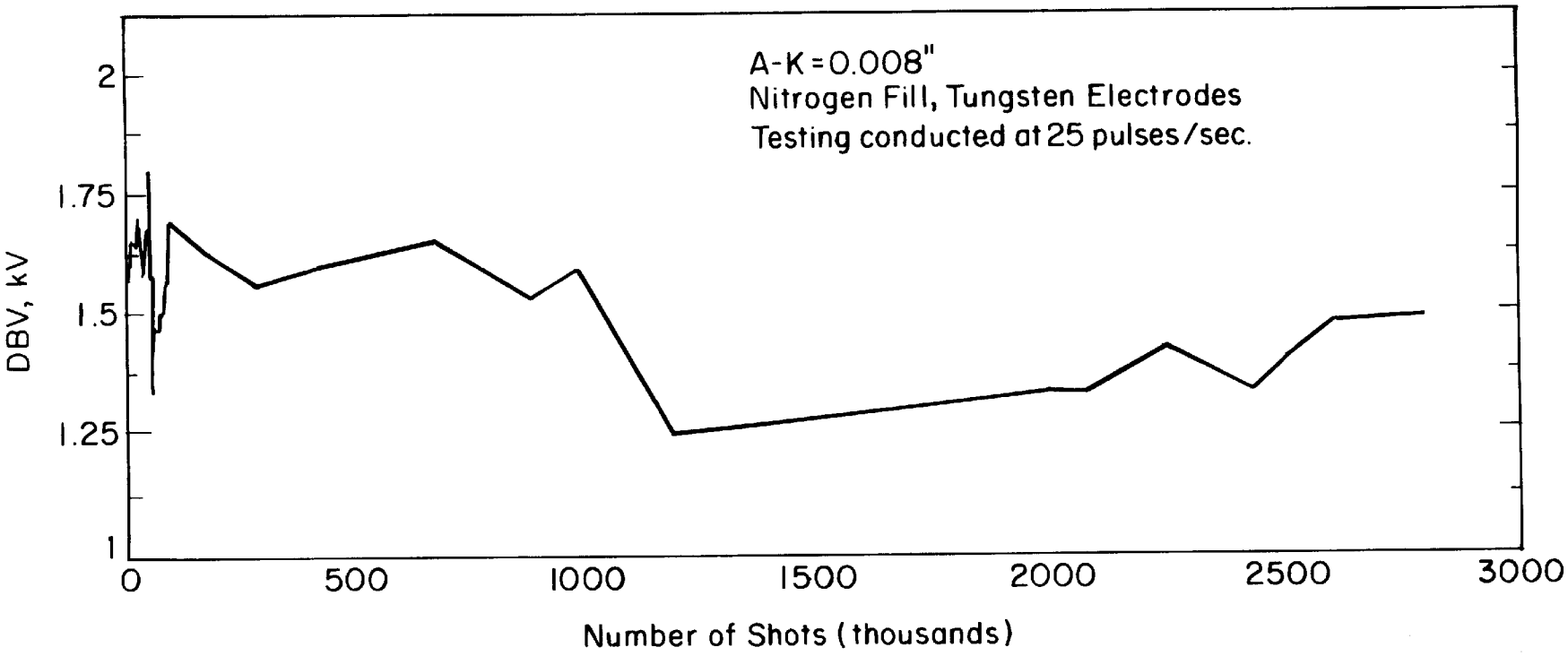
FIG. 14 is a graph depicting the performance of the spark gap device of this invention over millions of firings.

Each embodiment of the spark gap device disclosed herein has a life of many millions of firings in contrast to the severely limited life of prior art glass or ceramic spark gap devices. In the laboratory, two prototypes were constructed and tested. One unit was designed to switch 0.5 joules/shot, 1500 VDC breakdown and run at 25 Hz. Another was designed to run at the same rate but with an 850 VDC breakdown voltage. The device designed to have a 1500 VDC breakdown voltage survived nearly three million firings at 25 pulses per second as shown in FIG. 14 without failure.

The method of this invention utilizes low-cost components, for example standard TO-5 transistor components. Such a device has an increased life, on the order of millions of firings and is highly reliable. Since the housing is metal instead of glass or ceramic, it does not suffer from heat-related failures and is not susceptible to EMI and RFI damage. Expensive and complex ceramic to metal seals are not required. The spark gap device of this invention offers improved heat dissipation and heat sinking.

Although specific features of this invention are shown in some drawings and not others, this is for convenience only as each feature may be combined with any or all of the other features in accordance with the invention.

Other embodiments will occur to those skilled in the art and are within the following claims:

What is claimed is:

1. A method of manufacturing a spark gap device, the method comprising:

procuring a metal transistor base and cap;

machining a portion of said base to cut out a portion thereof;

filling said base with an insulative substrate and placing a pin through the insulative substrate;

depositing a first electrode on the top portion of the base in electrical contact with the metal portion of the base; and sealing said cap with respect to said base.

2. The method of claim 1 further including the step of fixing a second electrode to said pin.

3. The method of claim 2 in which said second electrode is predominantly molybdenum.

4. The method of claim 1 further including the step of placing a trigger pin in electrical isolation with respect to said first electrode.

5. The method of claim 1 further including the step of depositing a second electrode on said cap.

6. The method of claim 5 in which said second electrode is deposited on an interior top surface of said cap.

7. The method of claim 1 further including the step of inserting a second pin through the top surface of said cap and electrically isolating said second pin with respect to the top surface of said cap.

8. The method of claim 7 further including the step of fixing a second electrode to said second pin.

9. The method of claim 1 in which said cap is made of Kovar.

10. The method of claim 1 in which said first electrode is predominantly tungsten.

11. The method of claim 10 in which said first electrode includes barium and nickel.

12. The method of claim 1 further including the step of filling the cap with a gas.

13. The method of claim 12 in which said gas is nitrogen.

14. The product made by the process of claim 1.

15. A spark gap device comprising:

a base including a top face with a conductive portion and an insulative portion;

a first pin extending through the insulative portion of the base;

a first electrode at least partially on the conductive portion of the top face of said base and spaced from said pin; and a conductive cap sealingly engaged to the conductive portion of said base.

16. The spark gap device of claim 15 in which said first pin further includes a conductive arm terminating in a flat second electrode spaced above said first electrode.

17. The spark gap device of claim 16 in which said flat second electrode is made of molybdenum.

18. The spark gap device of claim 15 further including a trigger pin electrically isolated with respect to said first electrode.

19. The spark gap device of claim 15 in which said first electrode is predominantly tungsten.

20. The spark gap device of claim 15 in which said cap is made of Kovar.

21. A spark gap device comprising:

a base including a top face with a conductive portion and an insulative portion;

a pin extending above said top face and through said insulative portion;

a first electrode residing at least partially on the conductive portion of the top face of the base and electrically isolated from said pin;

an arm with one end fixed to said pin and an opposite end including a flat second electrode spaced above said conductive cape; and a conductive cap sealingly engaged with respect to said base.

22. The spark gap device of claim 21 further including a trigger pin extending through said base terminating in a third electrode electrically isolated with respect to said first electrode and said flat second electrode.

23. A spark gap device comprising:

a base including:

a top face with a conductive portion and an insulative portion, a first electrode in electrical contact with the conductive portion of the base, and a second electrode electrically isolated from and spaced with respect to said first electrode; and a conductive cap sealingly engaged with respect to the base.

24. The spark gap device of claim 23 further including a pin extending through the insulative portion of the base and in electrical contact with said second electrode.

25. The spark gap device of claim 23 further including a trigger pin terminating in a third electrode electrically isolated with respect to said first electrode and said second electrode.

26. A spark gap device comprising:

a base including a conductive portion and an insulative portion;

a pin extending through the insulative portion of the base and terminating in a first flat electrode;

a conductive cap sealingly engaged with respect to said base; and a second flat electrode spaced from said first flat electrode along the longitudinal axis of the device and fixed to the interior top surface of the cap.

27. The spark gap device of claim 26 in which said top surface of said cap includes an insulative portion, the device further including a trigger pin extending through said insulative portion of the cap, said second flat electrode fixed to said trigger pin.

28. A sputter-resistant spark gap device comprising:

a housing including:

a base with a conductive portion and an insulative portion, a conductive cap sealingly engaged with respect to the conductive portion of the base; and first and second spaced electrodes within said housing, at least said first electrode electrically isolated with respect to said housing;

each electrode including a planar surface facing the opposing electrode to capture sputtering of electrode material from the opposing electrode.

29. The spark gap device of claim 28 in which said first electrode is fixed to a pin extending through said insulative portion of the base.

30. The spark gap device of claim 28 further including a trigger pin.

31. The spark gap device of claim 28 in which said second electrode resides on the conductive portion of said base.

32. The spark gap device of claim 28 in which said second electrode resides on the interior surface of said cap.

* * * * *